US007830229B2

(12) United States Patent
Burgess et al.

(10) Patent No.: US 7,830,229 B2
(45) Date of Patent: Nov. 9, 2010

(54) COAXIAL RESONATOR INCLUDING A METALLIZED AREA WITH INTERDIGITATED FINGERS

(75) Inventors: Scott Burgess, Albuquerque, NM (US); Justin R. Morga, Edgewood, NM (US)

(73) Assignee: CTS Corporation, Elkhart, IN (US)

( * ) Notice: Subject to any disclaimer, the term of this patent is extended or adjusted under 35 U.S.C. 154(b) by 159 days.

(21) Appl. No.: 12/148,960

(22) Filed: Apr. 24, 2008

(65) Prior Publication Data

US 2008/0266030 A1 Oct. 30, 2008

Related U.S. Application Data

(60) Provisional application No. 60/926,467, filed on Apr. 27, 2007.

(51) Int. Cl.
*H01P 7/04* (2006.01)

(52) U.S. Cl. ..... 333/222

(58) Field of Classification Search ..... 333/206, 333/222, 207, 223, 134
See application file for complete search history.

(56) References Cited

U.S. PATENT DOCUMENTS

| | | | | |
|---|---|---|---|---|
| 5,173,672 | A | 12/1992 | Heine | |
| 5,474,488 | A | 12/1995 | Yamamoto et al. | |
| 5,563,561 | A | 10/1996 | Ishihara et al. | |
| 5,783,978 | A | 7/1998 | Noguchi et al. | |
| 5,841,332 | A | 11/1998 | Hino | |
| 5,945,895 | A | 8/1999 | Ono | |
| 6,023,207 | A | 2/2000 | Ito et al. | |
| 6,081,174 | A | 6/2000 | Takei et al. | |
| 6,462,629 | B1 * | 10/2002 | Blair et al. | 333/134 |
| 6,498,542 | B1 | 12/2002 | Kuroda et al. | |
| 6,559,735 | B1 | 5/2003 | Hoang et al. | |

(Continued)

FOREIGN PATENT DOCUMENTS

| | | |
|---|---|---|
| EP | 0 303 216 | 2/1989 |

(Continued)

OTHER PUBLICATIONS

Pastor Yiminez J., PCT International Search Report mailed Sep. 26, 2008 re: International Application No. PCT/US2008/005273 filed Apr. 24, 2008.

(Continued)

*Primary Examiner*—Benny Lee
(74) *Attorney, Agent, or Firm*—Mark P. Bourgeois; Daniel J. Deneufbourg

(57) ABSTRACT

A coaxial resonator includes a core of dielectric material. A through-hole defines respective openings in the top and bottom surfaces of the core. The top surface further defines at least first and second metallized regions surrounding the through-hole opening and an unmetallized region therebetween. The first metallized region defines a resonator pad. An isolated metallized region on at least one of the side surfaces defines an input/output electrode. In one embodiment, one of the metallized regions on the top surface and the electrode define interdigitated fingers on the top surface. In another embodiment, the pad defines outwardly projecting corner ears and both the second metallized region and electrode define fingers protruding between the ears. In a further embodiment, the electrode extends across at least two of the side surfaces.

5 Claims, 7 Drawing Sheets

U.S. PATENT DOCUMENTS

| | | | | |
|---|---|---|---|---|
| 6,650,202 | B2 * | 11/2003 | Rogozine et al. | 333/134 |
| 6,677,836 | B2 | 1/2004 | Uchiyama et al. | |
| 6,680,661 | B2 | 1/2004 | Hiroshima et al. | |
| 6,737,943 | B2 | 5/2004 | Takubo et al. | |
| 2004/0174236 | A1 * | 9/2004 | Matthews | 333/206 |
| 2006/0261913 | A1 | 11/2006 | Ye | |

FOREIGN PATENT DOCUMENTS

| | | |
|---|---|---|
| EP | 0 865 094 | 9/1998 |
| WO | WO 01/52344 | 7/2001 |

OTHER PUBLICATIONS

Pastor, Yiminez J., PCT Written Opinion of the International Searching Authority mailed Sep. 26, 2008 re: International Application No. PCT/US2008/005273 filed Apr. 24, 2008.

* cited by examiner

COAXIAL RESONATOR INCLUDING A METALLIZED AREA WITH INTERDIGITATED FINGERS

CROSS-REFERENCE TO RELATED APPLICATIONS

This application claims the benefit of the filing date and disclosure of U.S. Provisional Application Ser. No. 60/926,467, filed on Apr. 27, 2007 which is explicitly incorporated herein by reference as are all references cited therein.

TECHNICAL FIELD

This invention relates to coaxial resonators for use with radio-frequency signals and, in particular, to ceramic coaxial resonators for use with oscillators or filters.

BACKGROUND

Coaxial resonators are used in oscillators, filters, duplex filters and other electronic circuits where a distributed inductance and capacitance is needed. Coaxial resonators can be made from ceramic materials or metal and can have a variety of shapes such, as square, rectangular, circular or cylindrical.

Coaxial resonators typically include one or more cylindrical passages, called through-holes, extending through a block or core of ceramic material. The block is substantially plated with a conductive material (i.e. metallized) on the outside walls and also on the inside walls formed by the resonator through-holes.

Coaxial resonators are typically either quarter wave resonators having one end fully metallized and the other end open (not metallized), or half wave resonators where both ends are open (not metallized).

The body of the coaxial resonator is typically soldered to a printed circuit board and a metal lead extends into the through-hole. The metal lead has one end soldered in the through-hole and the other end soldered to the printed circuit board. The use of metal leads creates unwanted parasitic effects in the circuit that can adversely affect some circuit designs.

A ceramic coaxial resonator can also be coupled to external circuitry such as a printed circuit board through the use of a consecutively plated pad on the outer conductor of the resonator that creates a capacitive coupling.

One problem with ceramic coaxial resonators is that different manufacturers use ceramic materials with slightly different dielectric constants, quality factor (Qu), and coupling methods that cause the coaxial resonators to have different shapes or footprints as mounted on the printed circuit board. This creates difficulty for other manufacturers to be able to exactly match the same shape or footprint that currently exists and therefore causes problems in adding additional suppliers of the coaxial resonators.

What is needed is a resonator coupling method that can match an existing coaxial resonator shape or footprint using a wide variety of ceramic materials that have different dielectric constants.

SUMMARY OF THE INVENTION

The present invention is directed to a coaxial resonator for use with an oscillator or filter.

The coaxial resonator comprises a core of dielectric material defining top and bottom surfaces and side surfaces; at least one through-hole extending through the core and terminating in respective openings in the top and bottom surfaces; a first metallized area on the top surface completely surrounding the through-hole opening in the top surface; a first unmetallized area on the top surface completely surrounding the first metallized area; a second metallized area on the top surface completely surrounding the first unmetallized area; and a third metallized area on at least one of the side surfaces.

In one embodiment, the core defines at least first, second, and third side surfaces, the second metallized area defines a plurality of spaced-apart fingers on the top surface, the third metallized area extends onto the top surface and defines a plurality of spaced-apart fingers on the top surface which are interdigitated with the fingers on the second metallized area, and the third unmetallized area extends on the first, second, and third side surfaces and on the top surface between the interdigitated fingers of the second and third metallized areas.

In another embodiment, the first metallized area defines at least four projecting peripheral corner portions, the second metallized area defines at least one finger projecting between a first set of the projecting peripheral corner portions of the first metallized area, and the third metallized area extends onto the top surface and between a second set of the projecting peripheral corner portions of the first metallized area.

In a further embodiment, the third metallized area extends across the first side surface and a portion of the second side surface. The portion extending on the second side surface defines a pair of spaced-apart fingers, and a fourth metallized area on the second side surface defines a finger extending between the pair of fingers on the third metallized area.

In yet a further embodiment, the third metallized area extends over a portion of the third side surface.

There are other advantages and features of this invention, which will be more readily apparent from the following detailed description of preferred embodiments of the invention, the drawings, and the appended claims.

BRIEF DESCRIPTION OF THE FIGURES

These and other features of the invention can best be understood by the following description of the accompanying Figures as follows.

The Figures are not drawn to scale.

DETAILED DESCRIPTION OF THE EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
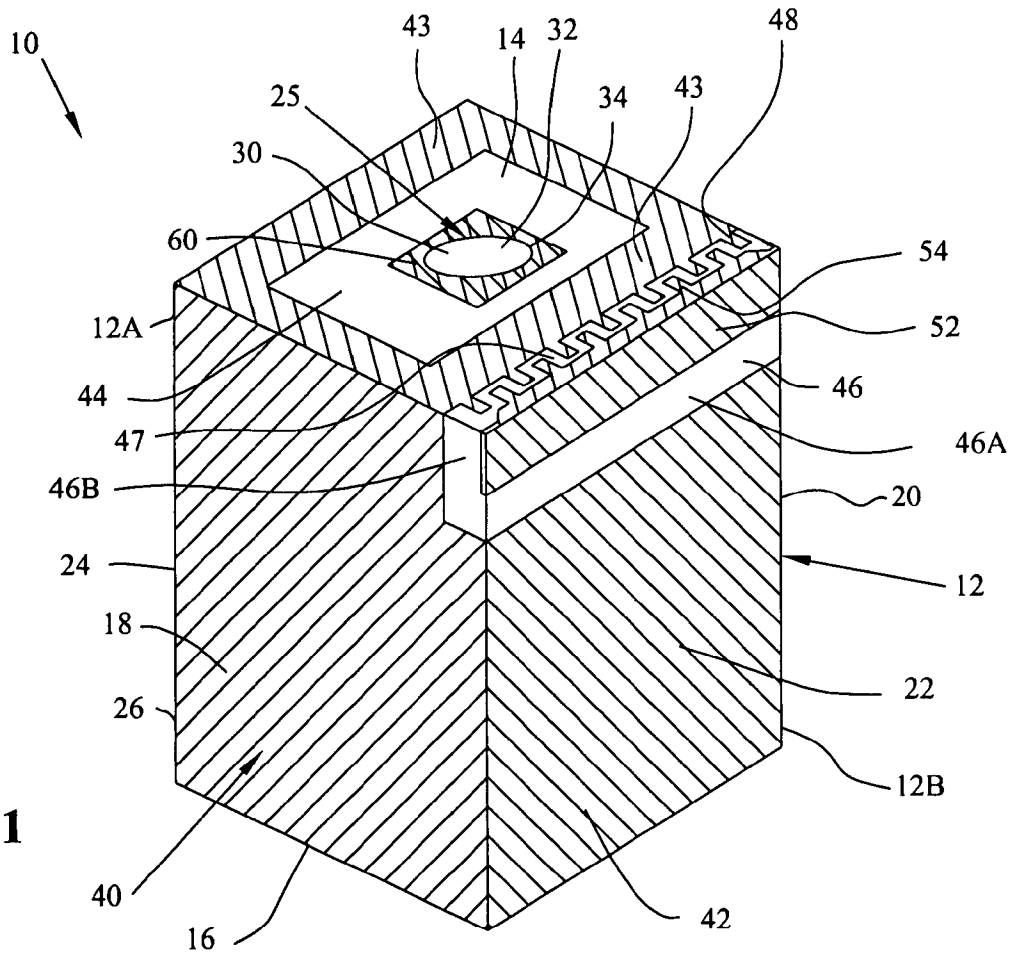
FIG. 1 is a perspective (or more precisely an isometric) view of a coaxial resonator according to the present invention.
Figure 1B:
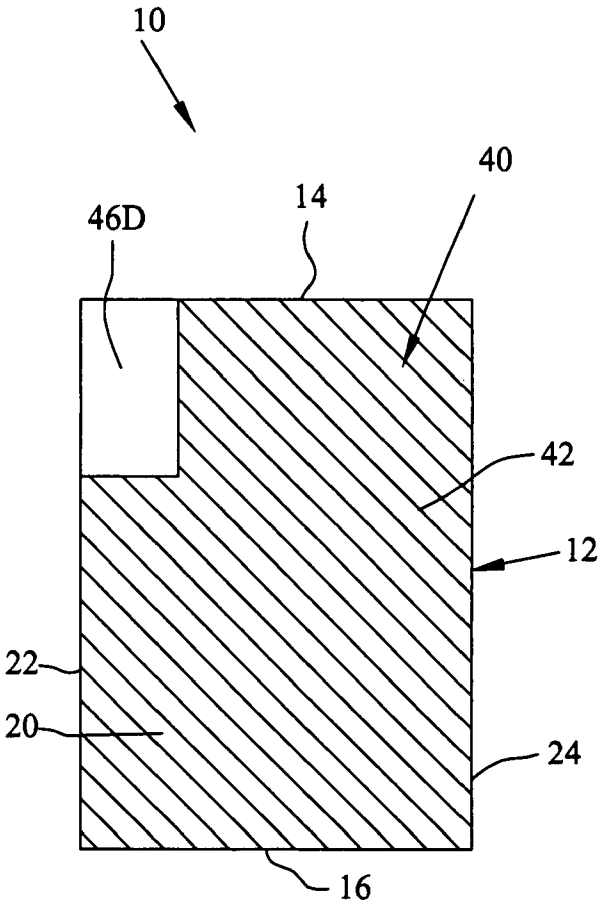
FIG. 1B is an elevational view of the side of the coaxial resonator opposite the side shown in FIG. 1A.
Figure 1A:
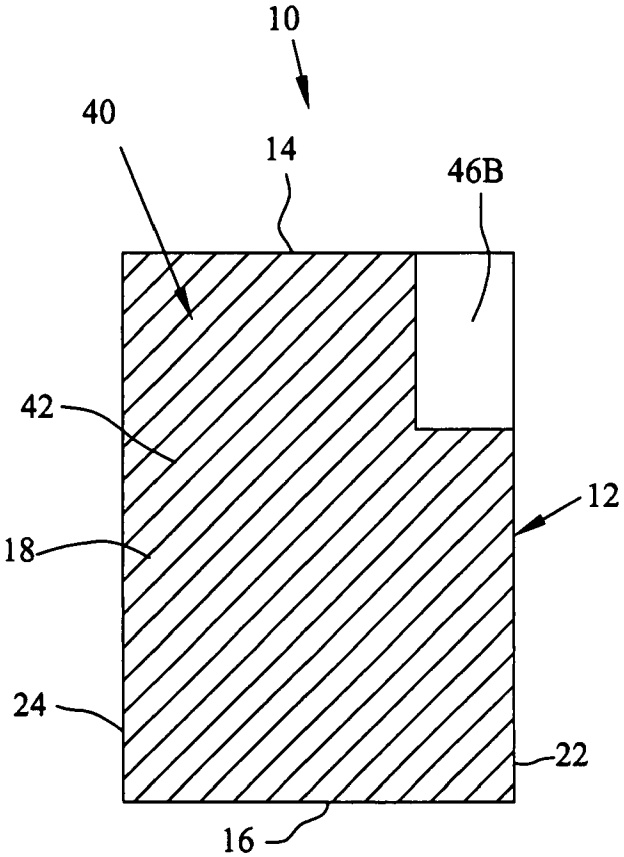
FIG. 1A is an elevational view of one of the sides of the coaxial resonator shown in FIG. 1.

Referring to FIGS. 1, 1A and 1B, a coaxial resonator 10 comprises an elongate, parallelepiped or box-shaped rigid core of ceramic dielectric material 12. The dielectric material is preferably barium or neodymium ceramic. Preferred dielectric materials for the rigid core 12 have a dielectric constant of about 37 or above. Core 12 has ends 12A and 12B (FIG. 1). Core 12 has an outer surface with six sides, a top 14, a bottom 16, a first side 18 (FIGS. 1, 1A), an opposite second side 20 (FIGS. 1, 1B), a third side 22, and an opposite fourth side 24. Multiple vertical edges 26 are defined by adjacent sides of core 12 (FIG. 1).

As shown in FIG. 1, coaxial resonator includes a resonator 25 defined by a metallized through-hole 30 extending through the interior of dielectric core 12. Through-hole 30 is generally cylindrical in shape and extends through the interior of core 12 between opening 34 terminating in top surface 14 and an opening (not shown) terminating in bottom surface 16 in a relationship generally normal to the top and bottom core surfaces 14 and 16. Through-hole 30 has an inner side wall surface 32. More than one through-hole 30 can be located in dielectric core 12 depending upon the application.

Core 12 has a surface-layer pattern 40 of metallized and unmetallized areas or patterns. The metallized areas are defined by a surface layer of conductive silver-containing material. Pattern 40 includes a wide area or pattern of metallization 42 that covers all of the bottom surface 16 (not shown) and side surface 24 (not shown). Wide area of metallization 42 also covers portions of top surface 14, side surfaces 18, 20, 22, and all of the inner wall 32 of through-hole 30. Metallized area 42 extends contiguously from within resonator hole 30 towards both top surface 14 and bottom surface 16. Metallization area 42 may also be labeled as, and defines, a ground electrode.

The more detailed aspects of pattern 40 are present on the top surface 14 and side surfaces 18, 20, and 22. Referring to FIG. 1, a metallized area is present on the top surface 14 in the form of a resonator pad 60, which completely surrounds opening 34. Resonator pad 60 which, in the embodiment shown is generally square-shaped, is adapted to have a predetermined capacitive coupling to adjacent areas of surface-layer metallization.

Two unmetallized areas or patterns 44 and 46 extend over portions of top surface 14 and portions of side surfaces 18, 20 and 22 (FIG. 1).

Contiguous unmetallized area 44, which is also generally square-shaped, completely surrounds metallized resonator pad 60. Unmetallized area 46 is in the form of an elongate, generally rectangularly-shaped strip or contiguous race-track including a first section 46A (FIG. 1) extending across the side surface 22 in a relationship normal to vertical core edges 26 and parallel and adjacent to the top surface 14, a serpentine-shaped second section 47 (FIG. 1) extending across the top surface 22 in a relationship spaced from, adjacent to, and parallel to the core edge which bridges top surface 24 and side surface 22, and third and fourth vertically extending sections 46B and 46D (FIGS. 1A and 1B respectively) defined on respective side surfaces 18 and 20 which are joined to the ends of sections 46A and 47 to complete the track and define single, continuous unmetallized region 46. Sections 46B and 46D are oriented in a relationship generally normal to the core edge which bridges top surface 14 and respective side surfaces 18 and 20. Each of the tracks defining each of the areas has a different configuration or pattern providing predetermined electrical characteristics.

As shown in FIG. 1, top surface 14 further defines an area of metallization 43 which completely surrounds unmetallized area 44. Area of metallization 43 is defined in part by a strip or section 43A of metallized area 43 on top surface 14 that extends in a relationship generally parallel and spaced from the core edge which joins top surface 14 and side surface 22 and including a plurality of spaced-apart and parallel fingers 48 projecting outwardly therefrom from the strip 43 in the direction of side surface 22 in a relationship generally normal to the core edge which joins top surface 14 and side surface 22.

The other strips of area of metallization 43 extend over the top peripheral edges of top surface 14 and into the areas of metallization on side surfaces 18, 20, and 24 and bottom surface 16 which define area of metallization 42.

The surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material.

Wide area of metallization 42 additionally includes a pair of isolated metallized areas for connection to other components or for mounting to a printed circuit board.

An elongate metallized isolated connection area or electrode or input/output pad 52 is located and defined on side surface 22 and extends upwardly over the core edge joining side surface 22 and top surface 14. Electrode 52, which extends the width of side surface 22 and is positioned adjacent and parallel to the core edge which bridges side surface 22 and top surface 14, further defines a plurality of spaced-apart and parallel fingers 54 on the top surface 14 that extend from electrode 52 in the direction of opening 34. Contiguous unmetallized area 46 completely surrounds the electrode 52.

Fingers 54 extend along the width of top surface 14 in a spaced-apart and parallel relationship between respective fingers 48 on metallized strip 43A. In other words, fingers 48 and 54 are interdigitated so as to define between the fingers the generally unmetallized sinuous, snake-like, or serpentine-shaped section 47 of unmetallized area 46.

It is noted that the interdigitated fingers 48 and 54 are located between the electrode 52 and portion 43A of metallized area 43. Metallized area 42 may be connected to ground in one type of application.

The surface-layer pattern 40 of metallized and unmetallized areas on core 12 is prepared by providing a rigid core of dielectric material including one or more through-holes 30 to predetermined dimensions. The outer surfaces and through-hole side walls are coated with a metal layer, preferably including silver, by spraying, plating or dipping. The preferred method of coating the dielectric core 12 varies according to the number of cores to be coated. After coating, the surface-layer pattern 40 and, more specifically, the unmetallized regions or areas thereof are preferably created by laser ablation of the metal over areas designated to be unmetallized. This laser ablation approach results in unmetallized areas recessed into the respective surfaces of core 12 because laser ablation removes both the metal layer and a slight portion of the dielectric material.

Figure 2:
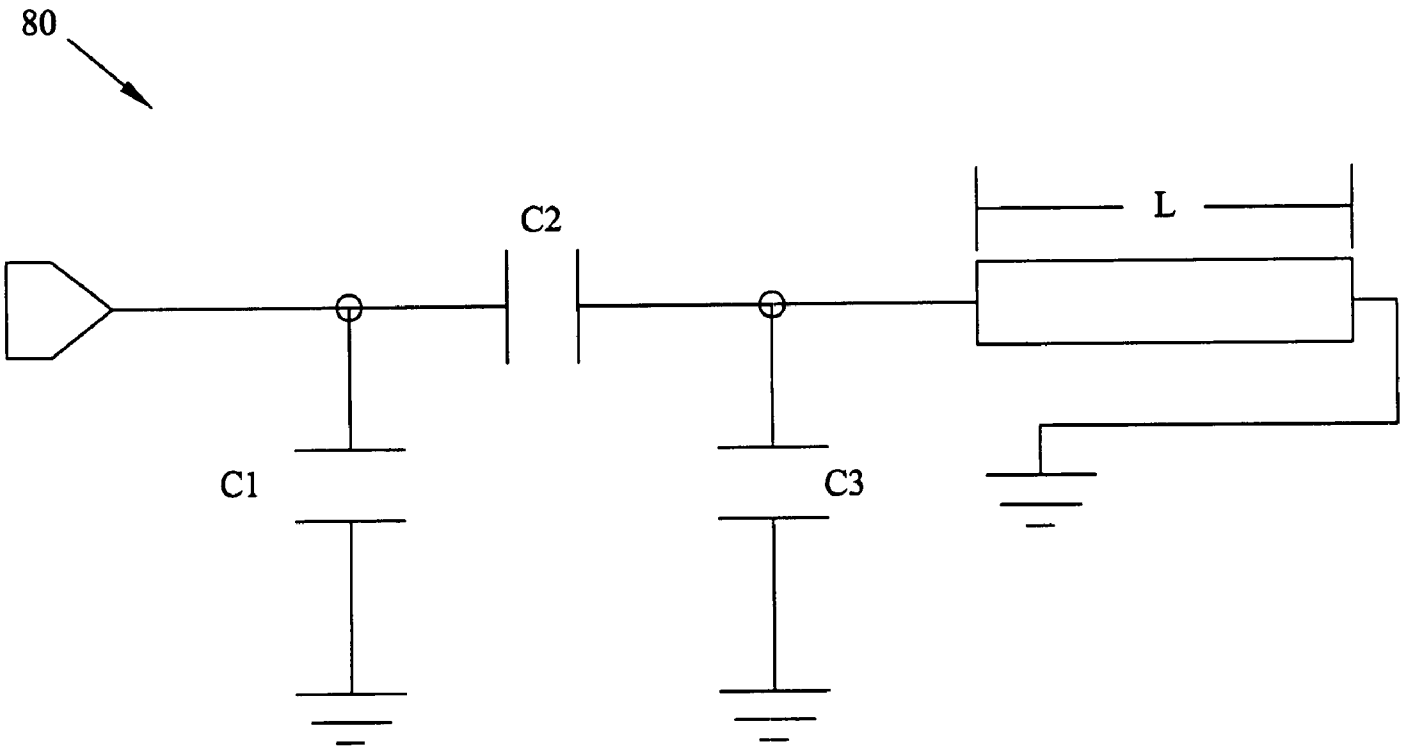
FIG. 2 is a schematic diagram of the equivalent electrical circuit of the coaxial resonator shown in FIG. 1.

FIG. 2 shows an equivalent electrical circuit 80 of the coaxial resonator 10 shown in FIG. 1. Resonator 25 in FIG. 1 is represented as a transmission line of length "L". Capacitor C1 represents the capacitance between electrode/metallized strip of material 52 and strip portion 43A of metallized area 42 in FIG. 1. The capacitance between electrode 52 and resonator pad 60 in FIG. 1 is represented by the capacitor C2. Capacitor C3 represents the capacitance between resonator pad 60 and metallized area 42 in FIG. 1. Circuit 80 is a capacitive pi-network that is connected to a short-circuited transmission line. The values of capacitors C1, C2 and C3 are determined by the spacing and dimensions of the pads, the hole spacing, the size of the capacitors (especially C2 and C3), the electrodes, the unmetallized areas, the dielectric constant of the dielectric material, and Qu.

As shown in FIG. 1, when metallized area 42 is connected to ground, portion/strip 43A acts as a ground potential electrically isolating electrode 52 from the resonator pad 60 such that the coupling of capacitor C2 is primarily through the dielectric material.

The capacitor "C3" and the short-circuited transmission line L create a parallel inductor/capacitor circuit that resonates at a specific frequency determined by the transmission line length "L" and the value of "C3" capacitor. The transmission line length can be precisely controlled to fit most circuit board footprints primarily by changing the value of capacitor C3. If the length of the transmission line needs to be shorter, capacitor C3 can be increased keeping the resonator at the desired frequency.

A resonator needs to electrically couple to other circuitry in order to be of use. This coupling can be achieved by connecting a capacitor (or inductor) to the resonant circuit (represented by the transmission line L and capacitor C3). The electrode coupling is represented by capacitor "C2". As the electrode becomes larger, the value of the "C2" capacitor will increase. If a customer has a circuit board footprint of a specific size, the "C2" value will be fixed to a capacitive value representing the physical dimensions of the electrode. It is probable that the customer footprint requirement will be such that the "C2" value is too large to properly couple the resonant circuit to the external circuitry. In this case, the capacitance of capacitor "C1" can be increased to make "C2" electrically look like a smaller capacitor value. In effect, a physically larger electrode can electrically look much smaller by adjusting the value of capacitor C1.

1st Alternative Embodiment

Figure 3:
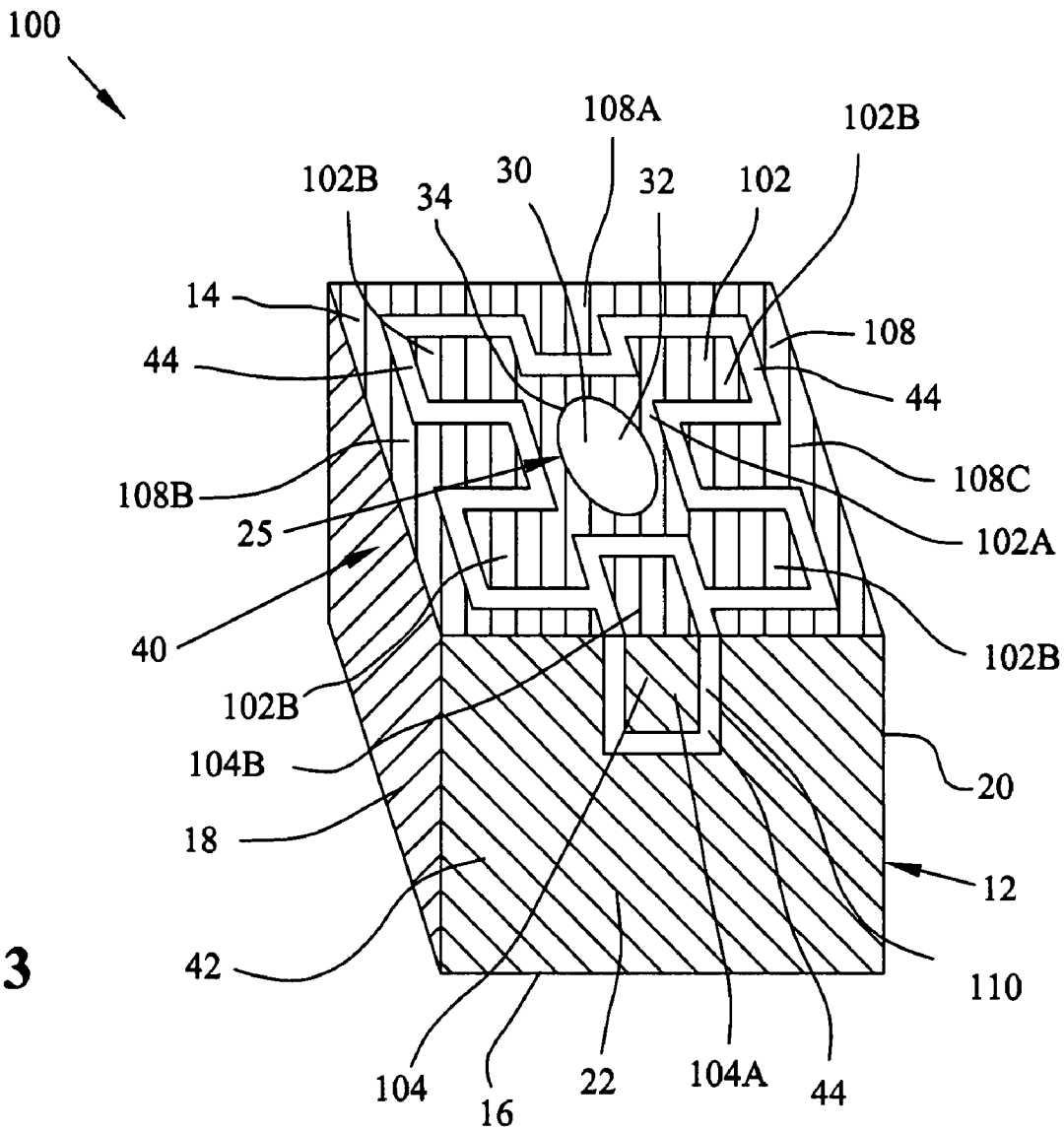
FIG. 3 is an isometric view of an alternative embodiment of a coaxial resonator according to the present invention.

FIG. 3 depicts an alternative embodiment of a coaxial resonator 100 according to the present invention. Coaxial resonator 100 is similar to coaxial resonator 10 except that coaxial resonator 100 does not have any inter-digitated fingers in input/output pad or electrode 104 and the shape of resonator pad 102 is different. Coaxial resonator 100 is also different in that it includes only one non-metallized area or track 44. Coaxial resonator 100 thus provides an alternative coupling design.

It is understood that certain numerals used in FIG. 1 have been used in FIG. 3 to denote elements common to both the FIG. 1 and FIG. 3 embodiments, and thus the earlier description of such elements in connection with the FIG. 1 embodiment is incorporated herein by reference with respect to the FIG. 3 embodiment, unless otherwise described to the contrary in more detail below.

An input/output pad or electrode or isolated region of metallization 104 is defined by a generally centrally located, rectangularly-shaped strip of metallization which bridges the side edge extending between side surface 22 and top surface 14. Pad 104 extends in an orientation generally normal to the edge which bridges top surface 14 and side surface 22 and is completely surrounded by a portion 110 of contiguous unmetallized area or track 44. Pad 104 includes a portion 104A on side surface 22 and a portion 104B on top surface 14.

Opening 34 in top surface 14, of generally oval-shaped through-hole 32 which extends through the interior of core 12 between top and bottom surfaces 14 and 16, is surrounded by a resonator pad or pattern or area of metallization 102 on the top surface 14 which is defined by a first large generally rectangularly-shaped center section 102A and four smaller generally rectangularly-shaped corner portions, extensions or sections or points 102B which protrude or extend outwardly from each of the corners of the section 102A respectively in an orientation generally normal to the long sides of the center section 102A.

Resonator pad 102 generally resembles a star shape with four peripheral corner points or projections or ears, or alternatively a rectangle with four rectangular corner sections. An unmetallized strip or area 44 completely surrounds the pad 102.

Input/output pad or electrode 104 defines a finger 104B which extends into and between and spaced from and parallel to the two lower pad sections 102B. Unmetallized strip 44 separates finger 104B from the resonator pad 102. The unmetallized strip 44 is completely surrounded by, and spaced from, a strip or region 108 of metallization on top surface 14 which bridges and extends into each of the core side surfaces and, more specifically, the metallization regions thereon defining surface-layer metallization pattern 40. Metallization region 108 defines fingers 108A, 108B, and 108C. Finger 108A extends between and projects into the space between the two upper pad sections 102B of metallization pattern or pad 102, finger 108B extends and projects into the space between two of the side sections 102B, and finger 108C extends and projects into the space between the two opposed side sections 102B. Fingers 108B and 108C are oriented in an opposed, co-linear relationship on opposite sides of metallized pad 102. Fingers 108A and 104B are oriented in an opposed, co-linear relationship opposite the other two sides of resonator pad 102. Each of the fingers 108 is spaced from and positioned in a relationship generally parallel to the respective pad sections 102B.

All of the fingers 104B, 108A, 108B, and 108C and projections 102B are spaced from one another and separated by unmetallized strip 44 therebetween.

The equivalent electrical circuit 80 of coaxial resonator 100 is also represented in FIG. 2. Resonator 25 in FIG. 3 is represented as a transmission line of length "L". Capacitor C1 represents the capacitance between electrode/pad 104 and metallized area 42. The capacitance between electrode 104 and resonator pad 102 is represented by the capacitor C2. Capacitor C3 represents the capacitance between resonator pad 102 and metallized area 42 in FIG. 3. Circuit 80 is a capacitive pi-network that is connected to a short-circuited transmission line. The values of capacitors C1, C2 and C3 are determined by the spacing and dimensions of the pads, the hole spacing, the size of the capacitors (especially C2 and C3), the electrodes, the unmetallized areas, the dielectric constant of the dielectric material, and Qu.

In FIG. 2, the coupling of capacitor C2 is primarily related to the spacing between electrode 104 and resonator pad 102 with a small amount of coupling occurring through the dielectric material.

Because the resonator pad 102 in FIG. 3 is larger, the edges of resonator pad 102 are closer to the metallized area 42 in FIG. 3, the value of capacitor C3 is increased. Metallized area 42 is typically connected to a source of ground potential. A larger value of C3 allows for shorting of the resonator length L and creates a shorter overall length of block 12. This allows the overall shape or footprint of coaxial resonator 100 to be adjusted to fit the size requirements of a particular application. Coaxial resonator 100 is well suited for applications where the footprint of block 12 is not fixed and can be changed.

The capacitor "C3" and the short-circuited transmission line L create a parallel inductor/capacitor circuit that resonates at a specific frequency determined by the transmission line length "L" and the value of "C3" capacitor. The transmission line length can be precisely controlled to fit most circuit board footprints primarily by changing the value of capacitor C3. If the length of the transmission line needs to be shorter, capacitor C3 can be increased keeping the resonator at the desired frequency.

2nd Alternative Embodiment

Figure 5:
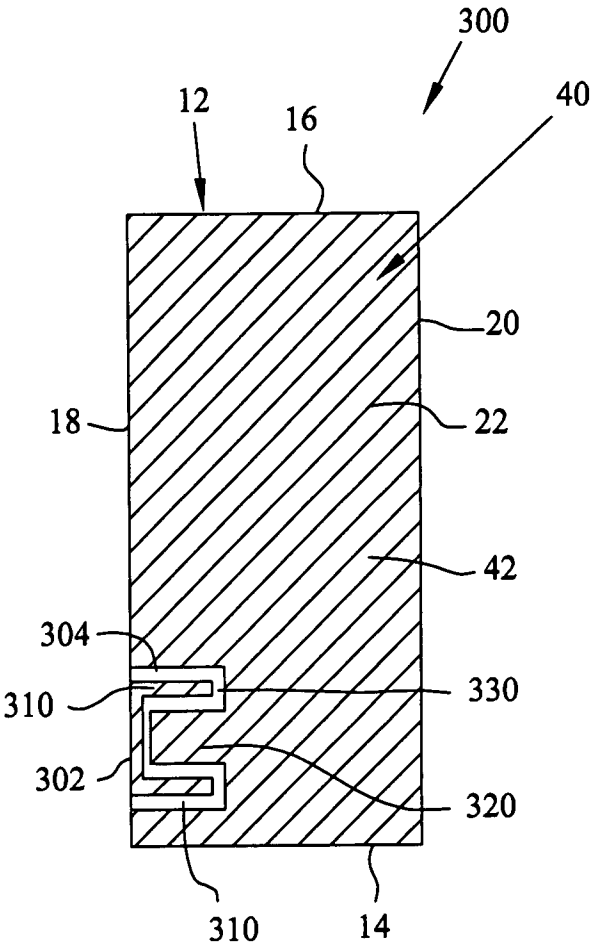
FIG. 5 is a side elevational view of the coaxial resonator of FIG. 4.
Figure 4:
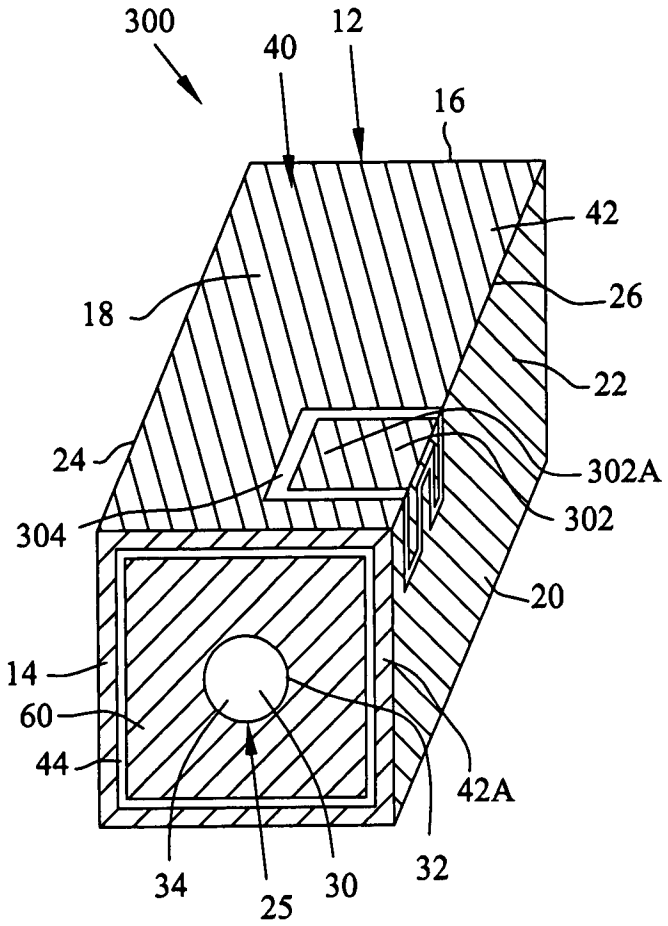
FIG. 4 is an isometric view of another embodiment of a coaxial resonator according to the present invention.

FIGS. 4 and 5 depict yet another embodiment of a coaxial resonator 300 according to the present invention. Coaxial resonator 300 is similar to coaxial resonator 10 except that coaxial resonator 300 has a different shape and location of the electrode/input-output pad/isolated region of metallization 302.

It is understood that certain numerals used in FIG. 1 have been used in FIGS. 4 and 5 to denote elements common to both the FIG. 1 and FIGS. 4 and 5 embodiments, and thus the earlier description of such elements in connection with the FIG. 1 embodiment is incorporated herein by reference with respect to the FIGS. 4 and 5 embodiment unless otherwise described to the contrary in more detail below.

Coaxial resonator 300 includes an electrode/pad/isolated region of metallization 302 that extends onto and bridges core side surfaces 18 and 22 and is positioned in a relationship spaced from and parallel to the core edge which joins top surface 14 and side surfaces 18 and 20. Electrode 302 extends along only a portion of side surfaces 18 and 22 in a relationship normal to the side edge 26 (FIG. 4) which bridges side surfaces 18 and 22 in a relationship parallel to and spaced from the side edge which bridges side surface 18 and top surface 14.

A contiguous non-metallized area or strip 304 completely surrounds electrode 302. Electrode 302 defines a generally rectangularly-shaped isolated strip of metallization 302A (FIG. 4) on side surface 18 and a pair of spaced-apart fingers 310 (FIG. 5) on side surface 22. Fingers 310 extend in a relationship normal to the side edge 26 which bridges side surfaces 18 and 22. A finger 320 (FIG. 5), defined by a portion of metallized area 42 on side surface 22, is interdigitated between the fingers 310. Finger 320 (FIG. 5) is parallel to and spaced from fingers 310. Non-metallized area 304 creates a sinuous or serpentine path or section 330 (FIG. 5) between the fingers 310 and 320.

Top surface 14 defines a generally rectangularly-shaped pad or area of metallization 60 which surrounds the circular opening 32 of metallized through-hole 30 as shown in FIG. 4 which extends through the core 12 between the top and bottom core surfaces 14 and 16. A region or contiguous race track pattern of unmetallization 44 (i.e., a region devoid of metal) completely surrounds the pad 60 as shown in FIG. 4. Another region of metallization 42A on top surface 14 surrounds region 44 as shown in FIG. 4. Region 42A is unitary with, and extends into, metallization region 42 which covers the side surfaces 18, 20, 22, and 24 and bottom surface 16.

Coaxial resonator 300 provides an alternative coupling design.

Referring back to FIG. 2, resonator 25 as shown in FIGS. 4, 5 is represented in equivalent electrical circuit 80 by transmission line of length "L". Capacitor C1 represents the capacitance between electrode 302 and metallized area 42 as shown in FIGS. 4, 5. The capacitance between electrode 302 and resonator pad 60 as shown in FIGS. 4, 5 is represented by the capacitor C2. Capacitor C3 represents the capacitance between resonator pad 60 and metallized area 42 as shown in FIGS. 4, 5. Circuit 80 is a capacitive pi-network that is connected to a short-circuited transmission line. The values of capacitors C1, C2 and C3 are determined by the spacing and dimensions of the pads, the hole spacing, the size of the capacitors (especially C2 and C3), the electrodes, the unmetallized areas, the dielectric constant of the dielectric material, and Qu.

The values of capacitors C1 and C2 can be adjusted by changing the length and spacing of fingers 310 and unmetallized sinuous strip 304.

3rd Alternative Embodiment

Figure 7:
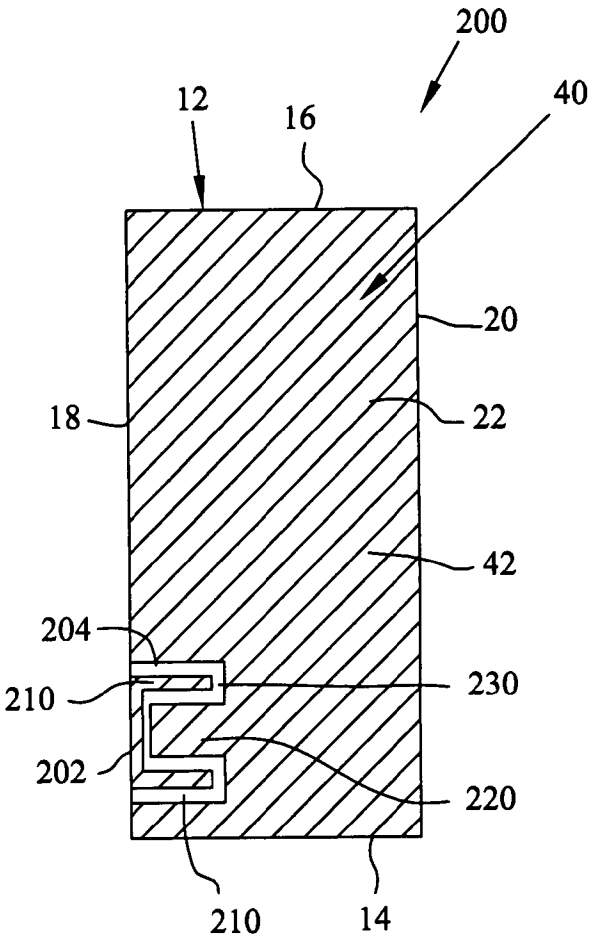
FIG. 7 is an elevational view of one of the sides of the coaxial resonator of FIG. 6.
Figure 6:
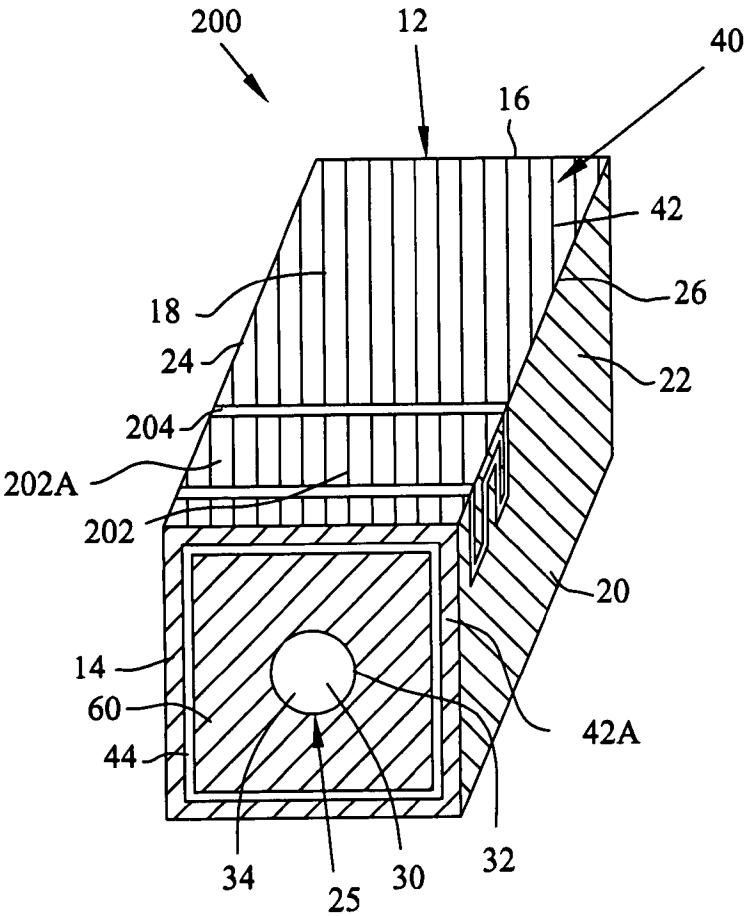
FIG. 6 is an isometric view of yet a further embodiment of a coaxial resonator according to the present invention.
Figure 8:
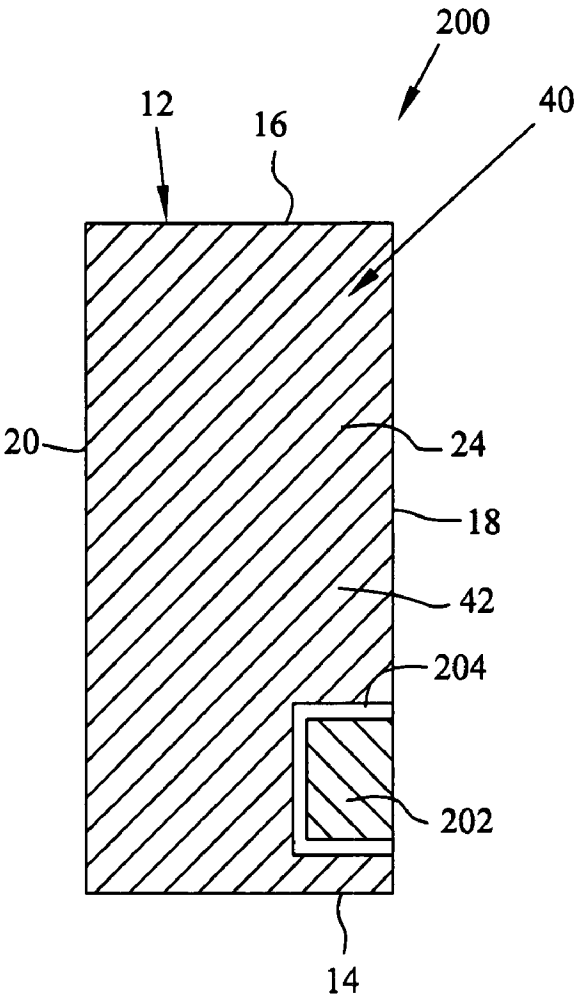
FIG. 8 is an elevational view of the side of the coaxial resonator opposite the side shown in FIG. 7.

FIGS. 6, 7 and 8 depict yet a further embodiment of a coaxial resonator 200 according to the present invention. Coaxial resonator 200 is similar to coaxial resonator 300 except that coaxial resonator 200 has a different shape and location of the electrode/input-output pad/isolated region of metallization 202.

It is understood that certain numerals used in FIG. 1 have been used in FIGS. 6, 7 and 8 to denote elements common to both the FIG. 1 and FIGS. 6, 7 and 8 embodiments, and thus the earlier description of such elements in connection with the FIG. 1 embodiment is incorporated herein by reference with respect to the FIGS. 6, 7, and 8 embodiments unless otherwise described to the contrary in more detail below.

Coaxial resonator 200 includes an electrode/pad/isolated region of metallization 202 that extends on side surface 18 and bridges onto portions of side surfaces 22 (FIGS. 6 and 7) and 24 (FIGS. 6 and 8). More specifically, electrode 202 extends the full width of side surface 18 and portions of side surfaces 22 and 24. A contiguous non-metallized area or strip 204 completely surrounds electrode 202. Electrode 202 extends in an orientation normal to the side edge 26 which bridges side surfaces 18 and 22 and is in an orientation parallel to and spaced from the edge 26 (FIG. 6) which bridges side surface 18 and top surface 14.

Electrode 202 defines a generally rectangularly-shaped strip of metallization 202A (FIG. 6) which extends the full width of side surface 18, a first end portion which bridges onto side surface 22 and defines a surface pair of spaced-apart and parallel fingers 210 (FIG. 7) on side surface 22 which extend in an orientation normal to the side edge 26 which bridges side surfaces 18 and 22, and an opposed second end which bridges onto a portion of side surface 22 (FIG. 7). A finger 220 (FIG. 7), defined by a strip of metallization on side surface 22, is interdigitated between fingers 210. Finger 220 (FIG. 7) is orientated and positioned in a relationship parallel to and spaced from the fingers 210. Non-metallized area 204 creates a sinuous or serpentine path 230 (FIG. 7) between fingers 210 and 220 (FIG. 7).

Top surface 14 defines a generally square-shaped pad or region or area of metallization 60 which surrounds the opening 32 of metallized through-hole 30 as shown in FIG. 6 which extends through the core 12 between the top and bottom core surfaces 14 and 16. A contiguous region or strip of unmetallization 44 completely surrounds the pad 60 as shown in FIG. 6. Another region of metallization 42A on top surface 14 completely surrounds region 44 as shown in FIG. 6. Region 42A is unitary with, extends into, and is in electrical coupling relationship with the metallization region 42 which covers the side surfaces 18, 20, 22, and 24 and bottom surface 16.

Coaxial resonator 200 provides an alternative coupling design.

With reference back to FIG. 2, resonator 25 in FIGS. 6-8 is represented in the equivalent electrical circuit 80 of FIG. 2 as a transmission line of length "L". Capacitor C1 represents the capacitance between electrode 202 and metallized area 42 in FIGS. 6-8. The capacitance between electrode 202 in FIGS. 6-8 and resonator pad 60 is represented by the capacitor C2. Capacitor C3 represents the capacitance between resonator pad 60 and metallized area 42 in FIGS. 6-8. Circuit 80 is a capacitive pi-network that is connected to a short-circuited transmission line. The values of capacitors C1, C2 and C3 are determined by the spacing and dimensions of the pads, the hole spacing, the size of the capacitors (especially C2 and C3), the electrodes, the unmetallized areas, the dielectric constant of the dielectric material, and Qu.

The values of capacitors C1 and C2 can be adjusted by changing the length and spacing of fingers 210 and sinuous path 230.

It is to be understood that no limitations with respect to the specific embodiments illustrated herein are intended or should be inferred. It is, of course, intended to cover by the appended claims all such modifications as fall within the scope of the claims.

We claim:

1. A coaxial resonator comprising:

a core of dielectric material having a top, a bottom, and first, second, third and fourth side surfaces;

at least one through-hole extending through the core between the top and bottom surfaces, the through-hole defining an inner surface and a resonator;

a resonator pad surrounding the through-hole;

a first contiguous unmetallized area located on the top surface and extending onto the first side surface;

a second contiguous unmetallized area located on the top surface surrounding the resonator pad;

a first metallized area located on the bottom surface, the side surfaces and the inner surface of the through-hole and contiguous with the resonator pad, a portion of the first metallized area extending onto the top surface in a relationship spaced and separate from the resonator pad and defining a first plurality of fingers;

an electrode located on the first side surface and extending onto the top surface; and a second plurality of fingers extending from the electrode and interdigitated with the first plurality of fingers defined on the first metallized area.

2. The coaxial resonator of claim 1 wherein the portion of the first metallized area extending onto the top surface surrounds the second unmetallized area.

3. The coaxial resonator of claim 1 wherein the first contiguous unmetallized area defines a sinuous path on the top surface between the electrode and a portion of the first metallized area which extends on the top surface.

4. A coaxial resonator comprising:

a core of dielectric material having a top, a bottom, and first, second, third, and fourth side surfaces;

at least one through-hole extending through the core between the top and bottom surfaces, the through-hole defining an inner surface and a resonator;

a resonator pad surrounding the through-hole;

a first contiguous unmetallized area located on the top surface and extending onto the third and fourth side surfaces;

a second contiguous unmetallized area located on the top surface surrounding the resonator pad;

a first metallized area located on the bottom surface, the side surfaces and the inner surface of the through-hole and contiguous with the resonator pad;

an electrode located on the first side surface and extending onto the top surface; and a first plurality of fingers extending from the electrode on the top surface.

5. A coaxial resonator comprising:

a core of dielectric material having a top, a bottom, and first, second, third and fourth side surfaces;

at least one through-hole extending through the core between the top and bottom surfaces, the through-hole defining an inner surface and a resonator;

a resonator pad surrounding the through-hole;

a first contiguous unmetallized area located on the top surface and extending onto the first side surface;

a second contiguous unmetallized area located on the top surface surrounding the resonator pad;

a first metallized area located on the bottom surface, the side surface and the inner surface of the through-hole and contiguous with the resonator pad;

an electrode located on the first side surface and extending onto the top surface, a portion of the first metallized area being located between the resonator pad and the electrode; and a first plurality of fingers extending from the electrode on the top surface.

* * * * *